US007935006B2

(12) United States Patent
Maina

(10) Patent No.: US 7,935,006 B2
(45) Date of Patent: May 3, 2011

(54) SOCCER BALL AND REMOVABLE SPIN TRAINING TETHER

(76) Inventor: Ryan Maina, Louisville, KY (US)

( * ) Notice: Subject to any disclaimer, the term of this patent is extended or adjusted under 35 U.S.C. 154(b) by 31 days.

(21) Appl. No.: 12/284,617

(22) Filed: Sep. 23, 2008

(65) Prior Publication Data

US 2010/0075784 A1 Mar. 25, 2010

(51) Int. Cl.
*A63B 69/00* (2006.01)

(52) U.S. Cl. ..... 473/424; 473/422; 473/429; 473/458

(58) Field of Classification Search ..... 473/422–425, 473/430, 506, 508; 273/334, 335
See application file for complete search history.

(56) References Cited

U.S. PATENT DOCUMENTS 3,588,104 A 6/1971 Griffin
3,804,409 A 4/1974 Schachner
4,071,241 A 1/1978 Garcia
4,247,117 A 1/1981 Reichert
4,278,257 A 7/1981 Garcia et al.
4,350,338 A 9/1982 May
4,462,599 A 7/1984 Brown
4,576,379 A 3/1986 Juhasz
4,687,209 A 8/1987 Carey
5,083,797 A 1/1992 Vartija et al.
5,398,940 A 3/1995 Derst
5,474,032 A 12/1995 Krietzman
5,586,760 A 12/1996 Hauter
5,620,186 A 4/1997 Dudley
5,692,975 A 12/1997 Hesse
6,168,539 B1 1/2001 Maina

*Primary Examiner* — Mitra Aryanpour
(74) *Attorney, Agent, or Firm* — David W. Carrithers; Carrithers Law Office PLLC

(57) ABSTRACT

An apparatus for soccer kicking practice comprises a soccer ball having a hidden attachment point and means of removably attaching a tether to the ball wherein the tether comprises a handle connecting a cord and elastic strip to a soccer ball in a manner allowing the ball to freely rotate with respect to the cord and the handle providing kicking and spinning of the ball and return of the ball to the user in a controlled manner. The device is designed to be readily attached or detached from the soccer ball for training or play.

7 Claims, 4 Drawing Sheets

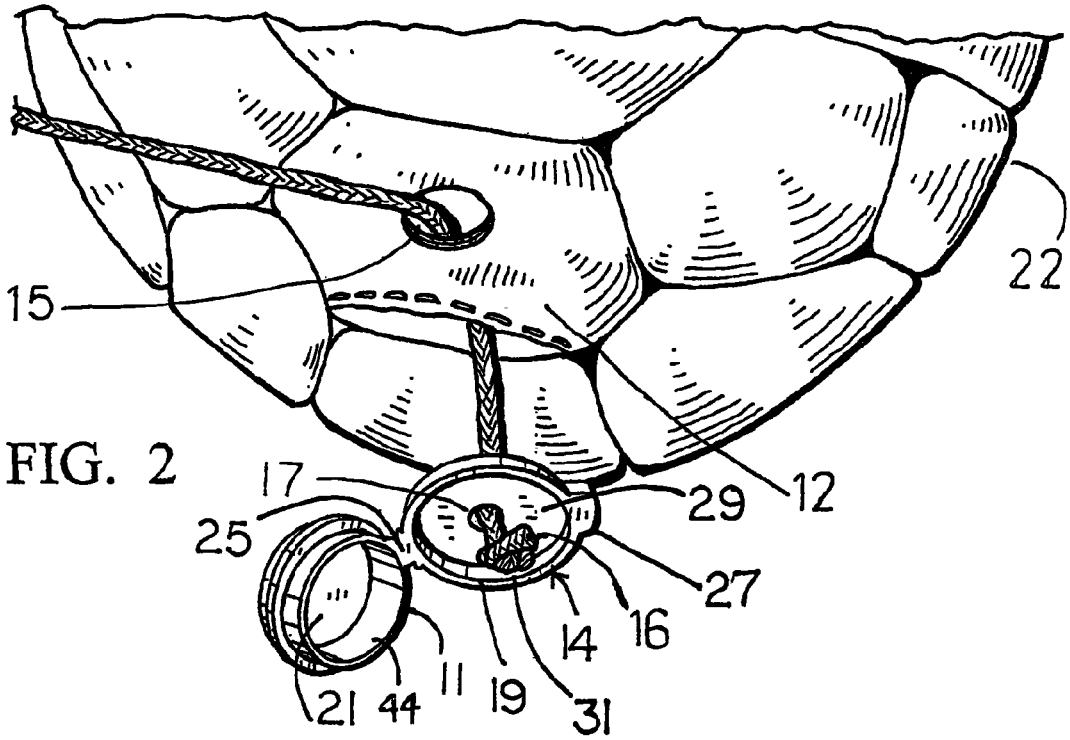
FIG. 2
FIG. 3
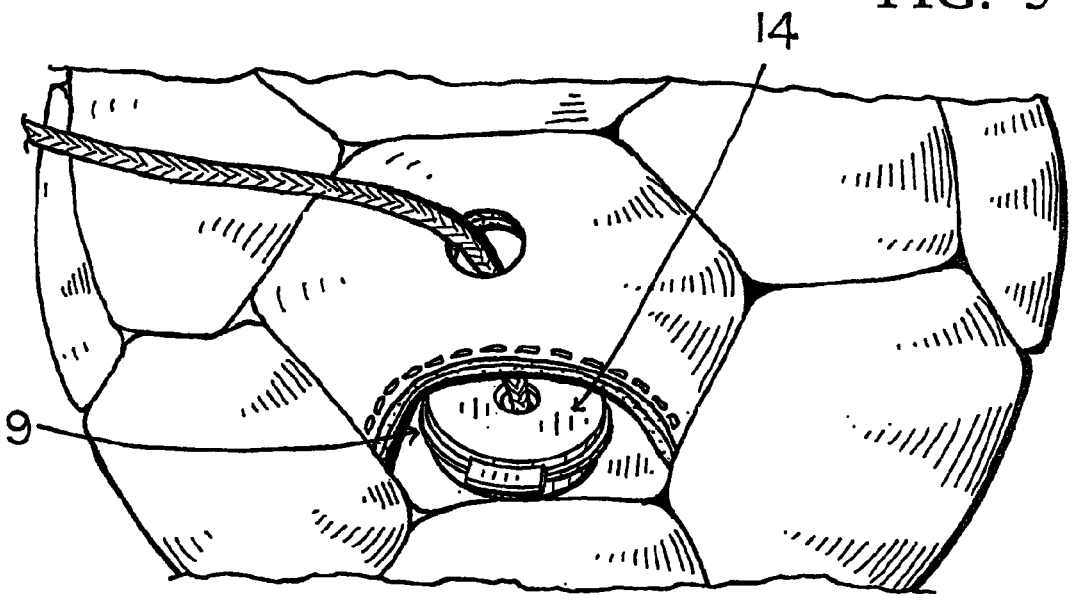

SOCCER BALL AND REMOVABLE SPIN TRAINING TETHER

TECHNICAL FIELD

The present invention relates to an apparatus for soccer kicking practice which comprises a soccer ball having a hidden attachment point for attachment of a tether attaching in a rotatable manner to the ball allowing for return of the ball in a controlled manner and preventing twisting of the tether.

BACKGROUND OF THE INVENTION

In the game of soccer, it is important to have good ball control, to be able to make accurate passes, to have good kick control, and confidence in ones ability to repeatedly kick the ball with anticipated and expected returns.

It is desirable to be able to practice kicking a soccer ball without the necessity of having another party retrieve the ball or having to retrieve the ball themselves. It may also be desirable to practice kicking the ball in a confined area such as indoor depending upon the weather conditions and practice space available to the kicker. It is also important to provide a means for storing and retrieval of the return apparatus with relative ease.

In most instances, players cannot pass the ball with their hands when it is in motion and must use their feet. The ball is primarily guided by the angle of the ball coming off the players, head or shoe. It is possible to also guide the ball by imparting back spins, or side spins to the ball causing the ball to curve up, down, or to one side or the other.

The closest prior art related to the present invention includes applicant's prior U.S. Pat. No. 6,168,539 which includes some of the features of the present invention. Other prior art references found in a search include: U.S. Pat. No. 3,588,104 by Griffin for "BASEBALL BATTING TRAINING DEVICE" which issued Jun. 28, 1971; U.S. Pat. No. 3,804,409 by Schachner for "KICKING PRACTICE AID" which issued Apr. 16, 1974; U.S. Pat. No. 4,071,241 by Garcia for "LARGE FOOT BALLS OR SOCCER BALLS" which issued Jan. 31, 1978; U.S. Pat. No. 4,247,117 by Reichert for "TORSO TETHERED TRAINING DEVICE" which issued Jan. 27, 1981; U.S. Pat. No. 4,278,257 by Garcia et al. for "SOCCER KICKING AID" which issued Jul. 14, 1981; U.S. Pat. No. 4,350,338 by May for "FOOTBALL PRACTICE AID" which issued Sep. 21, 1982; U.S. Pat. No. 4,462,599 by Brown for "SOCCER PRACTICE DEVICE" which issued Jul. 31, 1984; U.S. Pat. No. 4,576,379 by Juhasz for "SOCCER PRACTICE APPARATUS" which issued Mar. 18, 1986; U.S. Pat. No. 4,687,209 by Carey for "SOCCER TRAINING BALL ASSEMBLY" which issued Aug. 18, 1987; U.S. Pat. No. 5,083,797 by Vartija et al. for "GAME BALL TRAINING APPARATUS/CARRIER" which issued Jan. 28, 1992; U.S. Pat. No. 5,398,940 by Derst for "SOCCER HEADER PRACTICE APPARATUS" which issued Mar. 21, 1995; U.S. Pat. No. 5,474,032 by Krietzman for "SUSPENDED FELINE TOY AND EXERCISER" which issued Dec. 12, 1995; U.S. Pat. No. 5,586,760 by Hauter for "SOCCER TRAINING BALL FOR USE WITH A CORD SUSPENDED SOCCER BALL" which issued Dec. 24, 1996; U.S. Pat. No. 5,620,186 by Dudley for "SOCCER TRAINING AND PRACTICE DEVICE" which issued Apr. 15, 1997; U.S. Pat. No. 5,692,975 by Hesse for "SOCCER TRAINING AID" which issued Dec. 2, 1997, and U.S. Pat. No. 6,168,539 B1 by Maina for "SOCCER BALL SPIN TRAINING TETHER" which issued Jan. 2, 2001.

None of these conventional return devices provide a means for kicking the ball resulting in a "controlled" spin to affect the direction and path of the ball on the ground and/or through the air. Moreover, none of the typical devices now available provide a tethering return means whereby the attachment means is rotatably connected to the ball so that tension created by the spinning ball is not imparted to the tether so that the tether does not interfere with the spinning motion imparted to the kick.

SUMMARY OF THE INVENTION

The present invention provides an apparatus for soccer kicking practice including a soccer ball having a hidden attachment point and means of removably attaching a rotatable tether to the ball. A handle is connected to a distal end of a tether comprising an elastic cord fastened to the handled and having the proximate end of the elastic cord connected to a nonelastic cord by a rotatable leader. The nonelastic cord portion of the tether is threaded through a plurality of holes formed in an adjustment strip for adjustably lengthening or shorting the nonelastic cord to achieve the desired length of the tether. The distal end of the nonelastic cord is rotatably held in a closeable plastic keeper and more particularly the distal end of the cord is inserted into a pocket comprising a flap having a hole therein sown onto the surface of the ball and then through a bottom surface of a shallow cup and where a knot is formed on the distal end of the nonelastic cord. A lid is snapped closed on the cup defining a clamshell type of container whereby the knot can rotate within the container. The container is inserted into the pocket having a hole therein sewed onto the surface of a soccer ball and retained therein.

The soccer ball is secured to the tether in a manner allowing the ball to freely rotate with respect to the handle and to the tether providing kicking and spinning of the ball and return of the ball to the user in a controlled manner. The device is designed to be readily attached or detached from the soccer ball for training or play.

Because the tether is a attached to a soccer ball at a selected single point, a spin may be imparted to the ball upon the ball being kicked by a player. A portion of the tether is elastic and a portion of the tether is comprised of non-elastic material whereby the user can kick the ball and the ball will return to the kicker. Use of a elastic and non-elastic tether provides a means for the kicker to control the distance of the kick and the height and direction that the ball will travel upon returning to the kicker so that the ball may be kicked or butted repeatedly with reliable anticipation of the position of the ball upon the return.

For instance, by attaching the nonelastic portion of the tether to the ball and holding on to the elastic end, kicking the ball will result in its going outward from the kicker's foot at around knee height or below skimming the ground. In order to provide a higher return, the kicker can shorten the length of the elastic portion by adjusting his or her grip on the tether so that kicking the ball results in the ball returning at waist level, chest level, head level or higher in an arc when the ball reaches its farther most distance with the adjusted tether being fully extended.

The instant invention is especially good for training of a goalie wherein the ball can be bounced off of the ground and return to the goalie at head level.

The preferred embodiment uses a tether which is the length of the player from the tip of his fingers to the floor, generally from eight to ten feet, wherein a the section of the tether next to the player is formed of an elastic material so that the ball can be kicked and it returns to the player with the desired speed in an anticipated direction.

It is an object of the present invention to provide a soccer practice device whereby one can practice kicking the ball without the need of running to get the ball.

It is an object of the present invention to provide such a soccer practice device that allows the ball to freely spin and otherwise move roughly in the same manner as an untethered ball until the point at which the tether stops the ball.

It is an object of the present invention to provide a soccer practice device comprising a ball and a tether which one can attach to the ball or disconnect from the ball at will.

It is an object of the present invention to provide a tether having a distal end retained within a cup, plate, washer, plate or the like whereby insertion into a hole within a flap in a soccer ball provides free spinning rotation of the ball with respect to the tether.

It is an object of the present invention to provide a spinning leader as a means of attaching the nonelastic cord to an elastic cord providing free spinning motion therebetween.

It is an object of the present invention to include a tether having an length adjustment means comprising a strip or strap of material having at least two holes therein for forming a securing a loop and shortening the tether.

It is an object of the present invention to modify a soccer ball by sowing or otherwise attaching a patch of outer covering material or leather having a hole therein for insertion of the tether, whereby the patch covers an existing patch on the ball and the retaining patch of material includes an arcuate cutaway portion for slidably receiving a container having a distal end of the tether attaching thereto.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 2 is a partial view of a soccer ball with the extra flap attached, the plastic keeper and the tether cord passing through each;

FIG. 3 is a partial view of a soccer ball with the tether cord knotted within the plastic keeper which is closed and drawn back into the pocket formed by extra flap attached to the ball;

DETAILED DESCRIPTION OF PREFERRED EMBODIMENT

Figure 1:
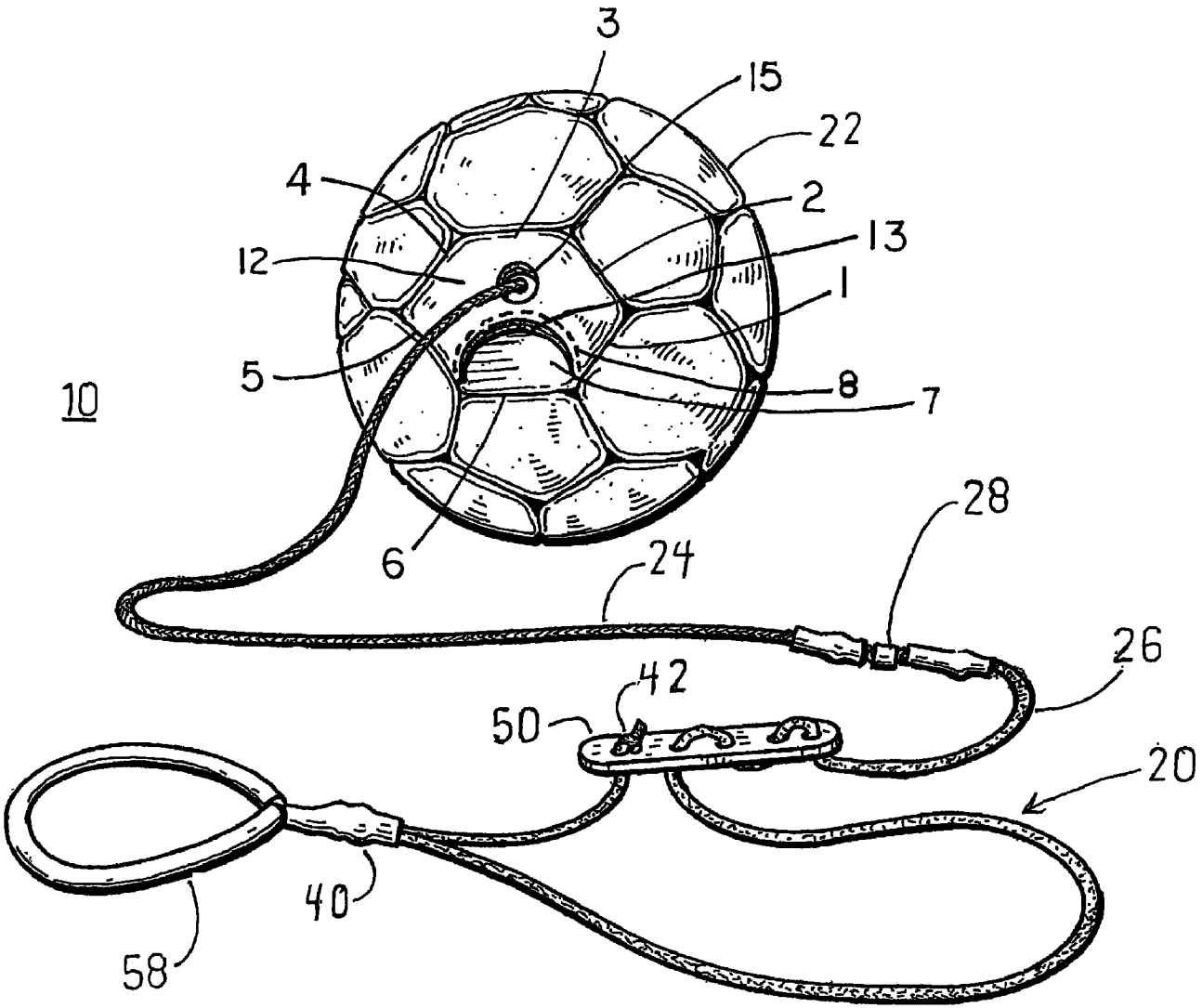
FIG. 1 is a perspective view of the present invention showing a soccer ball having the tether extending from a single point, wherein the tether is attached to the ball by removable means comprising an extra flap attached to the ball with an aperture through which the end of the tether cord is passed, a closable plastic keeper (not shown) with an aperture through which the end of the tether cord is passed and knotted, and the tether composed of an elastic and a non-elastic cord portion.
Figure 4:
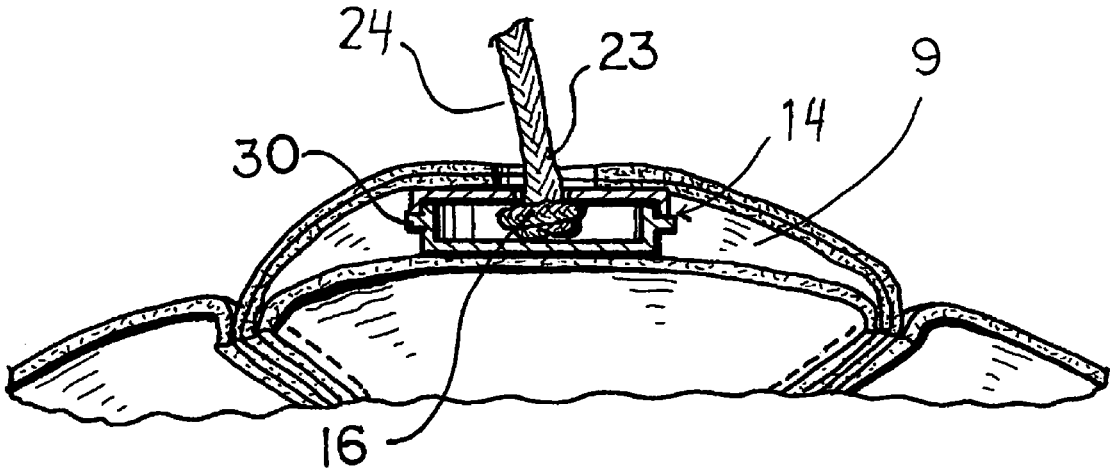
FIG. 4 is a cross sectional view of the extra flap as attached to a hexagonal section of the ball and the plastic keeper enclosing the knotted end of the tether cord.
Figure 5:
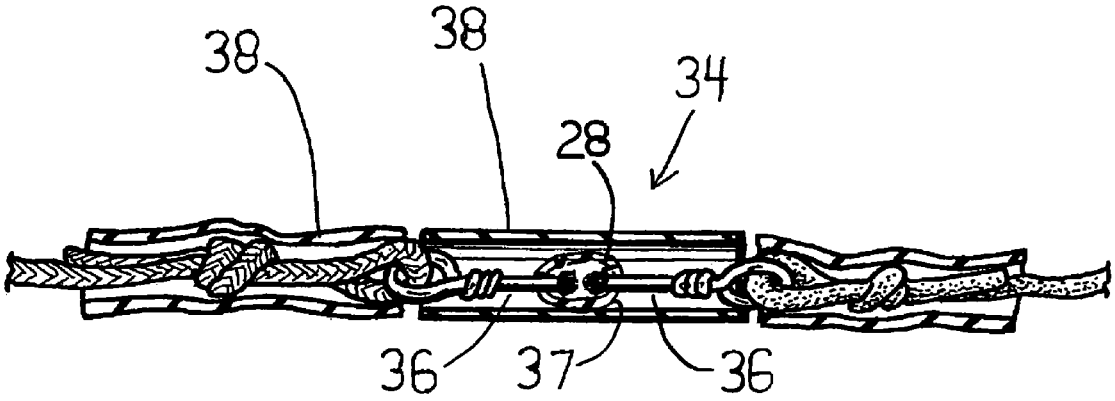
FIG. 5 is a cross sectional view of the elastic cord connected to the non-elastic cord by means of a swivelling leader comprised of two wires looped on one end with a bead affixed to the other end and the two beaded ends enclosed in a hollow metal bead.
Figure 6:
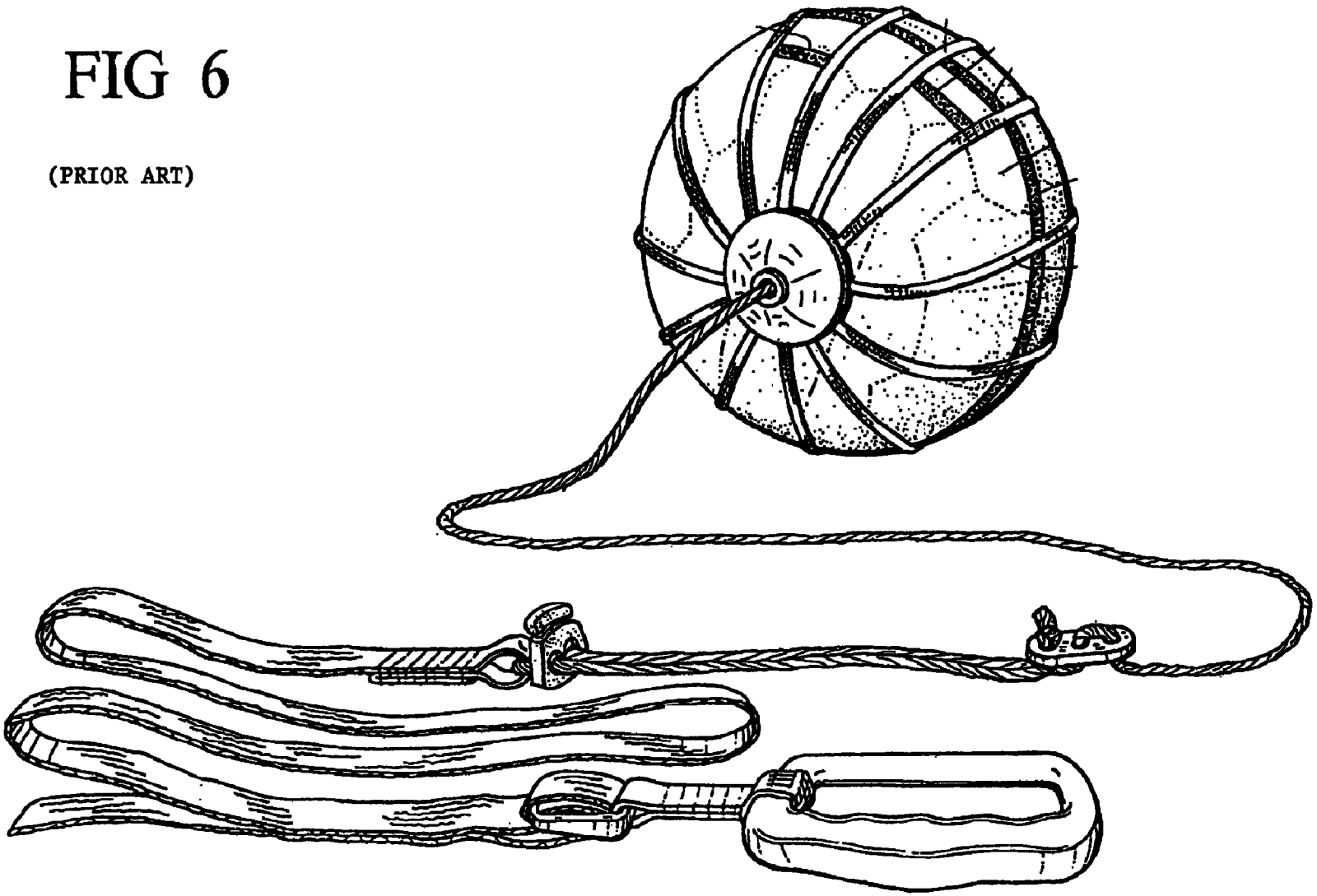
FIG 6 (PRIOR ART)
FIG. 6 is an isometric view of Applicant's prior art embodiment from U.S. Pat. No. 6,168,539.

The soccer ball spin training tether 10 will now be described with reference to the drawings FIGS. 1-5.

As shown in FIGS. 1-5, the soccer ball and spin training tether 10 of the present invention includes a modified soccer ball 22 and a spin training tether 20 removably fastened to the ball 22 by means for fastening extending from a single point providing a means for unrestricted controlled spinning of the ball 22.

Typically a soccer ball 22 is covered by a synthetic material sewn over a ball core so that a plurality of straight seams meet at angles forming patches in a pentagon or hexagon pattern. The modified soccer ball 22 of the present invention includes a retaining patch or retaining flap 12 of the same type of synthetic material covering the ball 22. A retaining patch or retaining flap 12 is selected to be roughly the same size and shape as the section over which it is sewn so that the seams holding the retaining flap 12 are the same or in alignment with the seams of the original covering material In one preferred embodiment, a retaining flap 12 is sewn over a patch having six sides, forming a hexagon. The pocket 9 comprises a retaining flap 12 five straight sewn seams and one seam 8 which is not sewn to the covering of the ball 22 forming an opening as best shown in FIG. 3. In one preferred embodiment the unsewn seam is an arcuate shape forming a semi-circular shaped retaining flap edge 13 forming a side opening allowing the tether cord 24 to pass through. The retaining flap 12 also includes a generally centered hole 15 for threading a distal end of the tether cord through and out of the side opening or pocket 9 in order for the cord to receive a keeper means and knotted end. Thus the retaining flap 12 covers an existing patch 7 on the ball 22 whereby the retaining patch 12 includes an arcuate cutaway portion 13 for slidably receiving a keeper 14 to rotatably hold the distal end 23 of the tether cord 24 wherein the keeper 14 comprises a clip, a washer, a bearing, a button, a container, or any generally flat holding member having a distal end of the tether rotatably secured thereto by means for holding.

The tether 20 is attached to the ball 22 by removable means comprising the extra retaining flap 12, wherein the distal end 23 of a tether cord (preferably nonelastic) is attached to the ball 22 by threading the distal end 23 through an aperture 15 of the retaining flap 12 and out through the opening forming the pocket 9. The distal end 23 of the tether cord 24 is inserted through an opening or aperture 17 of the retainer flap 12. A knot 16 formed which the end of the tether cord is passed, a closable keeper 14 with an aperture 15 through which the distal end 23 of the tether cord is passed and knotted forming a rotatable means for holding.

In the preferred embodiment shown in FIGS. 1-5, the retaining flap 12 is roughly the same size as the section over which it is sewn and is the same shape except that it contains a hole 15 for passing the cord 24 there through and one of the six sides has a semi-circular shaped portion omitted, forming an opening or pocket 9 allowing the tether cord 24 to pass through. Then the end of the cord 24 is passed through the aperture 15 of a plastic keeper 14 and is then knotted. As shown, the keeper 14 comprises a shallow circular container 19 having a bottom portion 11 formed by a base 21 having a side wall 44 extending upwardly therefrom. An optional plastic strap 25 holds a circular cap 27 defining a top surface 29 having an aperture 17 therein and sidewalls 31 extending downwardly therefrom of corresponding size and shape to form a snap fit with a lip 30 projecting from the side walls 44, a threaded fit, or a friction fit with the opposing side walls 44 of the base portion 11 of the keeper 14. It is contemplated that the knot 16 could be held by a keeper 14 by a clip or pin or that the distal end 23 of the tether could be rotatably held by the keeper 14 by a pin, a clip, or a rivet or other fastening means without a knot 16.

The knot 16 is pulled to rest against aperture 15 and the keeper 14 is snapped closed. The cord 24 and the keeper 14 are now pulled into the pocket 9 formed between the interior surface of the retainer flap 12 and the outer covering 7 of the ball 22.

The tether comprises a handle 58, an elastic portion 26 connected to a non-elastic cord portion 24 by a swivel device 28, and a length adjustment device, clip 50.

The tether 20 comprises a handle affixed to an elastic cord portion 26, such as a bungee cord, which is rotatably connected to a nonelastic cord portion 24 by a swivel device 28 which allows unrestricted swivelling and spinning of the ball 22. The swivel device 28 comprises a leader 34 including two wires 36 looped on one end with a bead affixed to the other end and the two beaded ends enclosed in a hollow metal bead 37. Each cord is tied or otherwise secured to the respective wire loops of the leader 34. The resulting knots and the leader are individually covered by flexible tubes 38 for protection of the user and the knots and leader 34. The protective tubes 38 or sheath also tends to restrict lateral and wobble movement of the leader 34 preventing twisting and binding of the tether 20 at the point of attachment of the nonelastic and elastic portions at the leader 34.

An adjustment strap means for shortening or lengthening the tether 20 is provided by a clip 50 defining a strip of material, (plastic, metal, wood), having a plurality of spaced apart holes extending longitudinally there along. The elastic cord 26 is inserted through two or more holes forming a simple loop which can be lengthened or shortened to achieve the desired length of the tether 20 and control of the ball. Of course it is contemplated that a knot in the cord may also be used to adjust the length of the cord 24 portion of the tether 20.

As shown in the drawings, the elastic cord 26 is passed through the clip 50. Then a knot 40 is tied to form a loop type handle 58 with the resulting end of the cord passing through clip 50 and being tied to make knot 42. The elastic used in the preferred embodiment is braided elastic so that the elastic stretches at a uniform rate rather than to "snap" back. This provides a means to kick the ball 22 coming back to you at about the same rate and momentum as imparted to the ball 22 by the kick moving the ball 22 away from the user. The ball 22 returns to the kicker just as if he was receiving it from another kicker.

Although an elastic cord 26 or a cord 24 may be used alone, the tether 20 combining both provides a means of directional control providing predictable returns.

The braided elastic strip 26 used in one preferred embodiment comprises about 50 to about 75 percent polyester and about 25 to about 40 percent rubber, and more particularly about 68 percent polyester and about 32 percent rubber. A handle 58 is attached to the distal end of the elastic strip 26 opposite the leader 28. This apportionment allows the user to hold the end of the handle 58 at chest height and kick the ball 22, whereby the ball is forced upward and returns at chest height. Holding the handle 58 lower results in the ball 22 being kicked parallel with the ground. By kicking the ball 22 on one side or the other, spin can be imparted to the ball 22 so that it rises, lowers, or curves to the left, right, or combinations thereof. Thus, adjustment of the length of the elastic cord 26 so that it is about ⅓ the length of the cord 24 causes the ball 22 to return high upon being kicked by the user. The shorter the elastic strip 26 as compared to the cord 24, the higher the ball will rise. This is very helpful in developing ball control for the chest and knees as well as for the feet, such as is important for a goal keeper.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

I claim:

1. A soccer ball spin training tether, comprising:

a spherical soccer ball having a tether extending from a single point, said tether removably attached to said soccer ball;

said tether composed of an elastic cord portion and a non-elastic cord portion;

said elastic cord portion capable of stretching at a uniform rate providing a smooth return of said soccer ball without jerking;

a retaining flap securely attached to said soccer ball, while maintaining a uniform exterior shape of said soccer ball;

a closable plastic keeper defining a housing having an aperture through which an end of said tether is passed and knotted, said retaining flap and said soccer ball forming a keeper-holding space therebetween, said retaining flap including an edge opening thereof and an aperture therethrough, said tether and said keeper are passed through said edge opening and maintained in said keeper-holding space, and an end of said tether passed through said aperture and extending outwardly;

a swivel lead connecting said elastic cord portion to said non-elastic cord portion allowing said soccer ball to spin freely; and a clip attached to said tether for adjusting a length of said tether.

2. The soccer ball spin training tether of claim 1, wherein said elastic portion of said tether is about one third the length of the cord portion.

3. The soccer ball spin training tether of claim 1, wherein said elastic portion of said tether is braided material.

4. The soccer ball spin training tether of claim 1, wherein said elastic portion of said tether comprises polyester and rubber.

5. The soccer ball spin training tether of claim 4, wherein said elastic portion comprises material ranging from about 50 to about 75 percent polyester and about 25 to about 40 percent rubber.

6. The soccer ball spin training tether of claim 5, wherein said elastic portion comprises about 68 percent polyester and about 32 percent rubber.

7. The soccer ball spin training tether of claim 1, including a shaped handle forming a closed loop extending from a distal end of said tether.

* * * * *